US006959696B2

(12) United States Patent
Shears et al.

(10) Patent No.: US 6,959,696 B2
(45) Date of Patent: Nov. 1, 2005

(54) INTERNAL COMBUSTION ENGINE EVAPORATIVE EMISSION CONTROL SYSTEM

(75) Inventors: Peter D. Shears, Wauwatosa, WI (US); Harold Milton Haskew, Milford, MI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/411,477

(22) Filed: Apr. 10, 2003

(65) Prior Publication Data

US 2004/0040546 A1 Mar. 4, 2004

Related U.S. Application Data

(60) Provisional application No. 60/372,268, filed on Apr. 12, 2002.

(51) Int. Cl.[7] ..... F02M 33/04

(52) U.S. Cl. ..... 123/516; 123/518; 123/519; 123/520

(58) Field of Search ..... 123/516, 518, 123/519, 520, 521, 198 DB, 198 E

(56) References Cited

U.S. PATENT DOCUMENTS

| | | | | |
|---|---|---|---|---|
| 2,358,840 | A | | 9/1944 | Walker |
| 3,391,679 | A | | 7/1968 | Williams et al. |
| 3,610,221 | A | | 10/1971 | Stoltman |
| 3,617,034 | A | | 11/1971 | Skinner |
| 3,645,244 | A | | 2/1972 | Seyfarth |
| 3,650,256 | A | | 3/1972 | Marshall |
| 3,696,799 | A | | 10/1972 | Gauck |
| 3,913,545 | A | | 10/1975 | Haase et al. |
| 4,112,898 | A | | 9/1978 | Takimoto et al. |
| 4,127,097 | A | | 11/1978 | Takimoto |
| 4,261,717 | A | * | 4/1981 | Belore et al. ..... 96/112 |
| 4,279,233 | A | * | 7/1981 | Tobita et al. ..... 123/519 |
| 4,475,522 | A | * | 10/1984 | Oonaka ..... 123/520 |
| 4,658,795 | A | * | 4/1987 | Kawashima et al. ..... 123/519 |
| 5,259,412 | A | | 11/1993 | Scott et al. |
| 5,408,977 | A | | 4/1995 | Cotton |
| 5,560,345 | A | * | 10/1996 | Geyer et al. ..... 123/516 |
| 5,727,531 | A | * | 3/1998 | Osanai ..... 123/520 |
| 6,189,516 | B1 | * | 2/2001 | Hei Ma ..... 123/524 |
| 6,330,879 | B1 | | 12/2001 | Kitamura et al. |

OTHER PUBLICATIONS

George A. Lavoie et al., "A Fuel Vapor Model (FVSMOD) for Evaporative Emissions System Design and Analysis," 1998 Society of Automotive Engineers, Inc.

(Continued)

*Primary Examiner*—Thomas Moulis
(74) *Attorney, Agent, or Firm*—Michael Best & Friedrich, LLP

(57) ABSTRACT

A fuel vapor control system that is adapted for use with internal combustion engines includes a fuel tank, an evaporative emission control device containing activated carbon and including a first orifice that fluidly communicates with the fuel tank via a vent line. A second orifice in the control device is open to the atmosphere. A purge tube is between a filter element and a venturi section of the engine and fluidly communicates with a third orifice in the control device via a vapor line. Fuel vapors are absorbed by the activated carbon when the engine is not running, and the carbon releases the fuel vapors to the engine via the purge tube when the engine is running.

38 Claims, 10 Drawing Sheets

OTHER PUBLICATIONS

H. Bauer.-ed., "Gasoline-Engine Management," 1999, p. 152, Robert Bosch GmbH.
H. Bauer.-ed., "Gasoline Engine Management," 1999, p. 288-289, Robert Bosch GmbH.
H. Bauer.-ed., "Gasoline Engine Management," 1999, pp. 343-345, Robert Bosch GmbH.
"Automotive Fuel Lines," Verlag Moderne Industie, 1998, p. 4.

* cited by examiner

INTERNAL COMBUSTION ENGINE EVAPORATIVE EMISSION CONTROL SYSTEM

This application claims the benefit of prior filed co-pending provisional patent application Ser. No. 60/372,268 filed on Apr. 12, 2002, which is incorporated by reference herein.

FIELD OF THE INVENTION

The invention relates to internal combustion engine emission control, and more particularly to control of fuel evaporative emissions utilizing a control device containing activated carbon.

BACKGROUND INFORMATION

Internal combustion engines are used in a variety of applications, such as lawnmowers, generators, pumps, snow blowers, and the like. Such engines usually have fuel tanks coupled thereto to supply fuel to the engine through a supply line. It is desirable to reduce emissions from devices powered by internal combustion engines. Even when the engine is not being used, the engine can release emissions of hydrocarbons or gasoline resulting from daily ambient temperature changes. Such emissions are known as "diurnal" emissions. To help reduce emissions from the engine, it is known to provide internal combustion engines with fuel shutoff devices that block the flow of fuel to the engine upon engine ignition shutdown. Without such a shutoff device, fuel is wasted, and unburned fuel is released into the environment, thereby increasing hydrocarbon exhaust emissions. Likewise, the presence of unburned fuel in the combustion chamber may cause dieseling. When the engine is not operating, pressure buildup in the fuel tank caused by increased ambient temperatures can force fuel into the engine, where the fuel can be released into the atmosphere.

It is also desirable to reduce emissions from the fuel tank. Fuel tanks are typically vented to the atmosphere to prevent pressure buildup in the tank. While the engine is operating and drawing fuel from the fuel tank, the vent in the fuel tank prevents excessive negative pressure inside the tank. While the engine is not operating (i.e., in times of non-use and storage), the vent prevents excessive positive pressure that can be caused by fuel and fuel vapor expansion inside the tank due to increased ambient temperatures. Fuel vapors are released to the atmosphere primarily when a slight positive pressure exists in the tank.

One method of venting fuel tanks includes designing a permanent vent into the fuel tank cap. Typically, the fuel tank is vented via the threads of the screw-on fuel tank cap. Even when the cap is screwed tightly on the tank, the threaded engagement does not provide an airtight seal. Therefore, the fuel tank is permanently vented to the atmosphere. Another method of venting fuel tanks includes the use of a vent conduit that extends away from the tank to vent vapors to a portion of the engine (i.e., the intake manifold) or to the atmosphere at a location remote from the tank.

SUMMARY OF THE INVENTION

The present invention provides a self purging evaporative emission control system. The control system is adapted for use with an internal combustion engine that has an operating condition and a non-operating condition. The evaporative emission control system includes an engine intake assembly that provides intake air to the engine and an evaporative emission device that includes vapor adsorbing material. The system also includes a fuel tank that provides fuel to the engine and a vent conduit that provides fluid communication between the fuel tank and the evaporative emission device. An atmospheric vent provides fluid communication between the evaporative emission device and the atmosphere, and a vapor conduit provides fluid communication between the evaporative emission device and the engine intake assembly. The vent conduit is configured to conduct fuel vapor from the fuel tank to the evaporative emission device at least when the engine is in the non-operating condition, and the vapor conduit is configured to conduct fuel vapor from the evaporative emission device to the engine intake assembly in response to a decrease in pressure in the engine intake assembly when the engine is in the operating condition. Fuel vapors are therefore adsorbed by and removed from the vapor adsorbing material.

Other features and advantages of the invention will become apparent to those skilled in the art upon review of the following detailed description and drawings.

Figure 1:
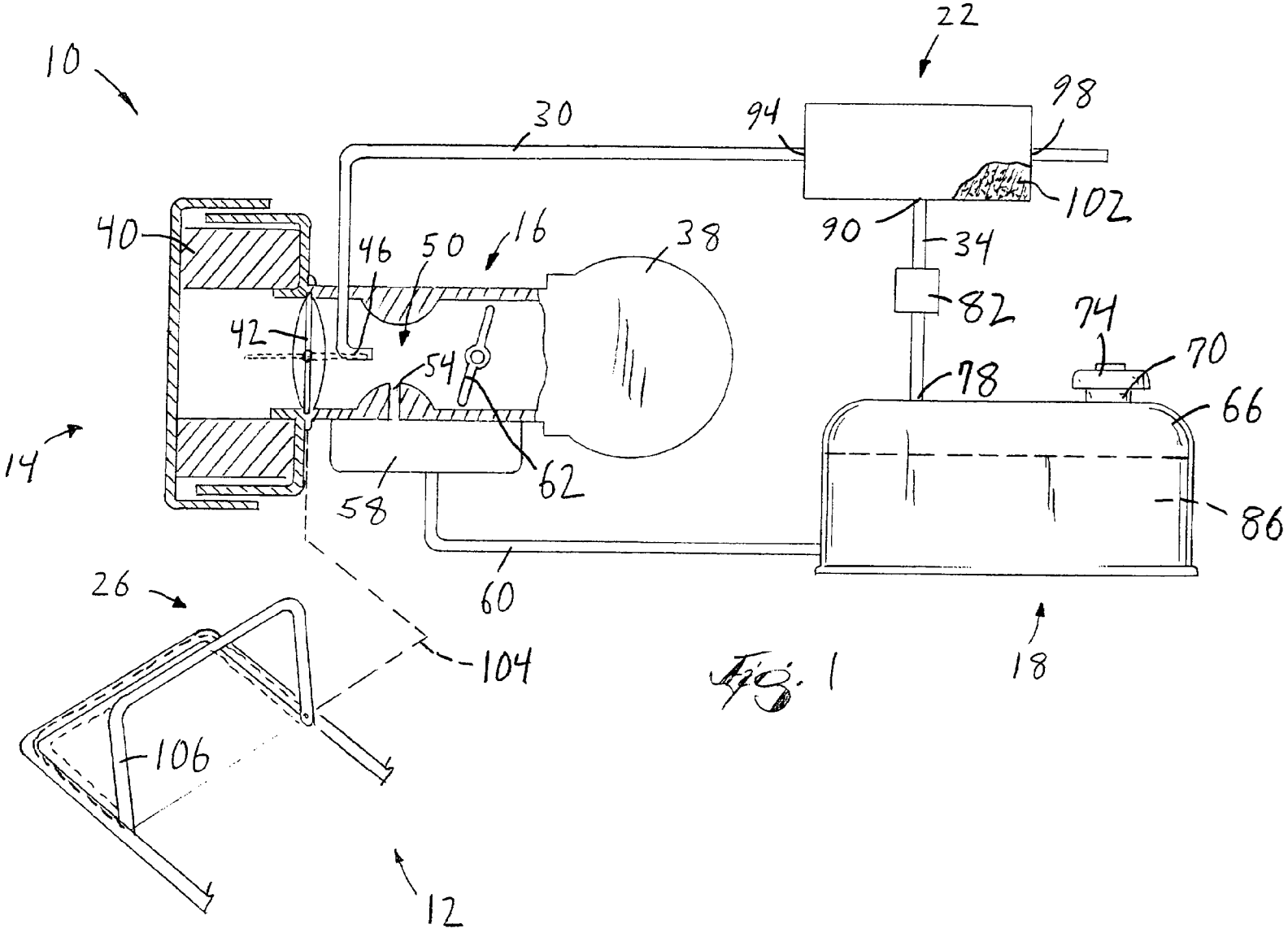
FIG. 1 is a schematic view of an internal-combustion-engine-powered device having a fuel vapor control system embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 8:
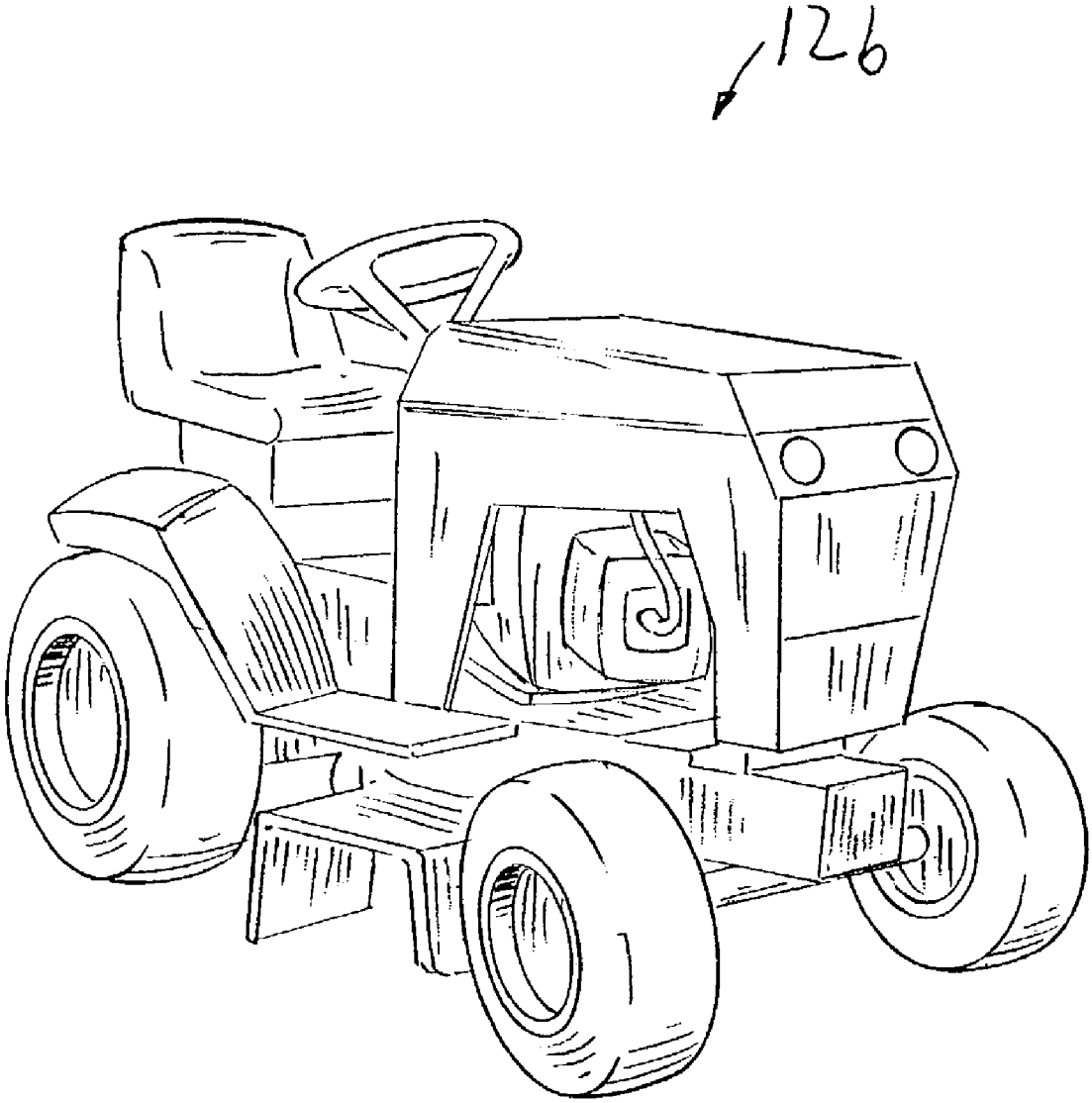
FIG. 8 is a lawn tractor having an internal combustion engine embodying the invention.
Figure 9:
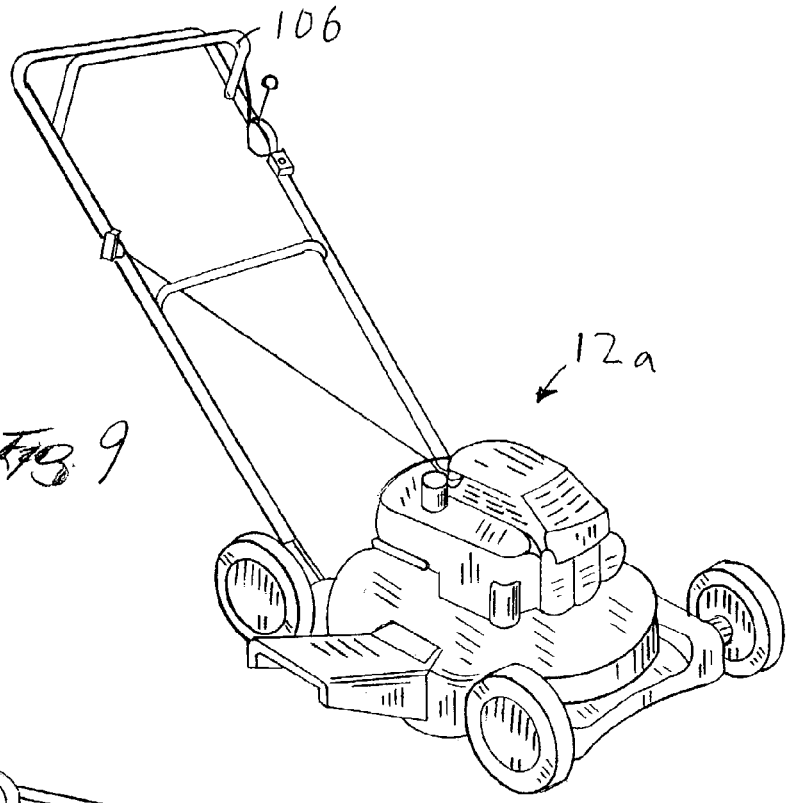
FIG. 9 is a walk-behind lawnmower having an internal combustion engine embodying the invention.
Figure 10:
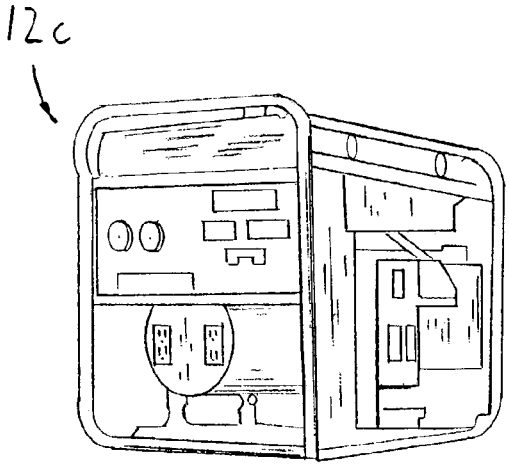
FIG. 10 is a portable generator having an internal combustion engine embodying the invention.
Figure 11:
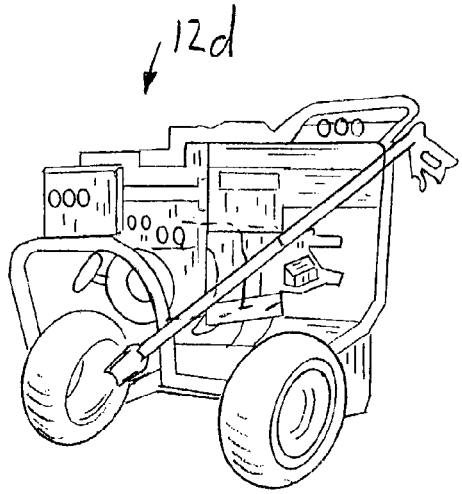
FIG. 11 is a portable pressure washer having an internal combustion engine embodying the invention.
Figure 12:
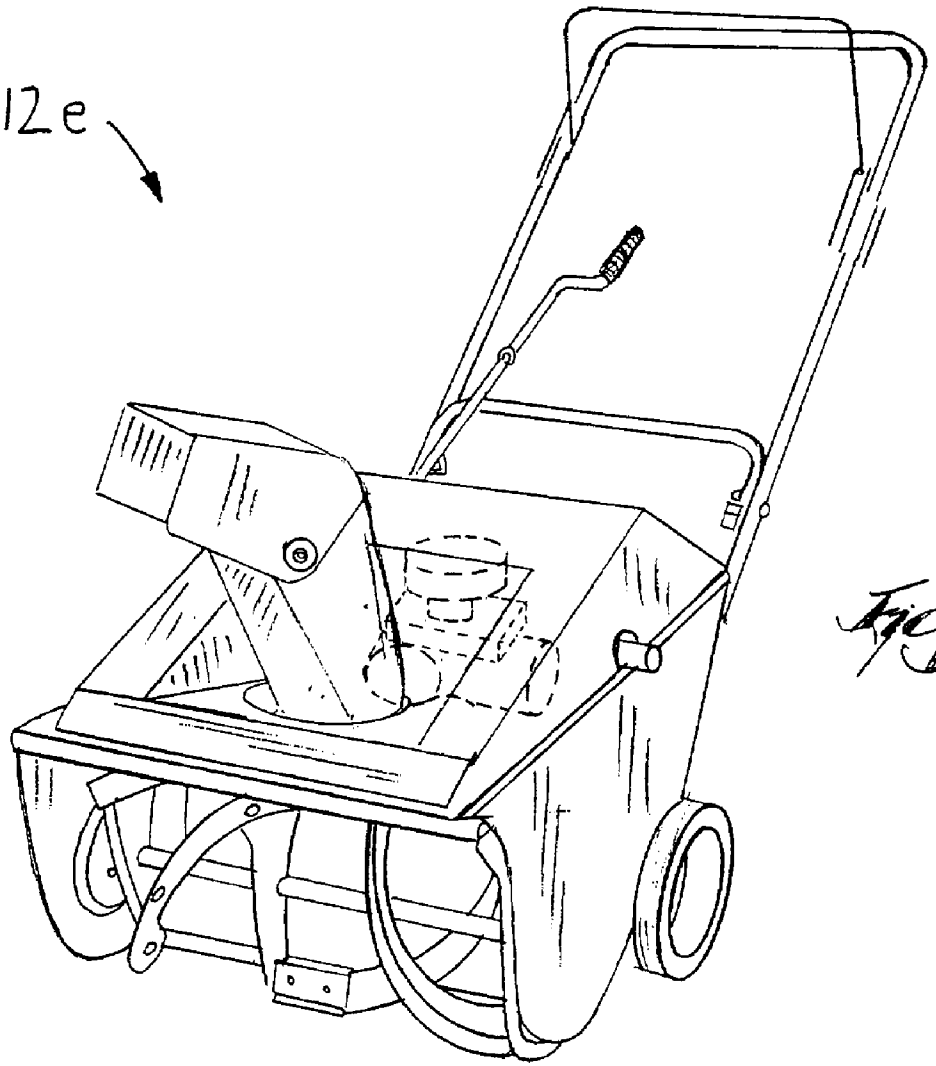
FIG. 12 is a snowthrower having an internal combustion engine embodying the invention.
Figure 13:
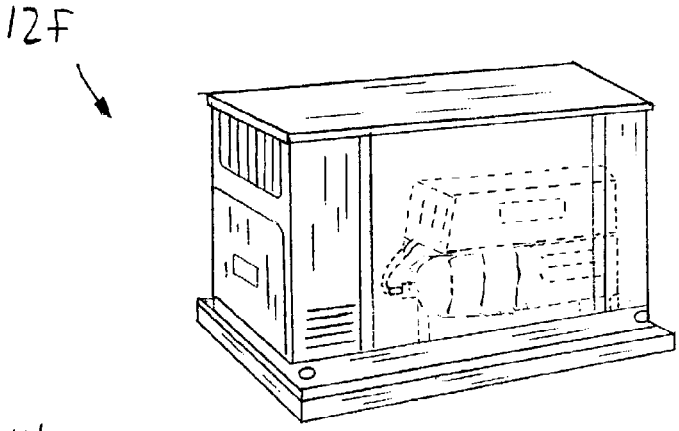
FIG. 13 is an automatic backup power system having an internal combustion engine embodying the invention.
Figure 14:
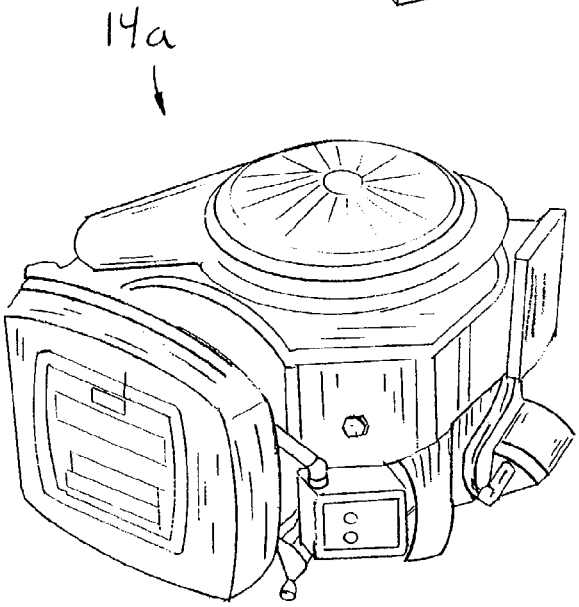
FIG. 14 is a multi-cylinder, V-twin internal combustion engine embodying the invention.
Figure 15:
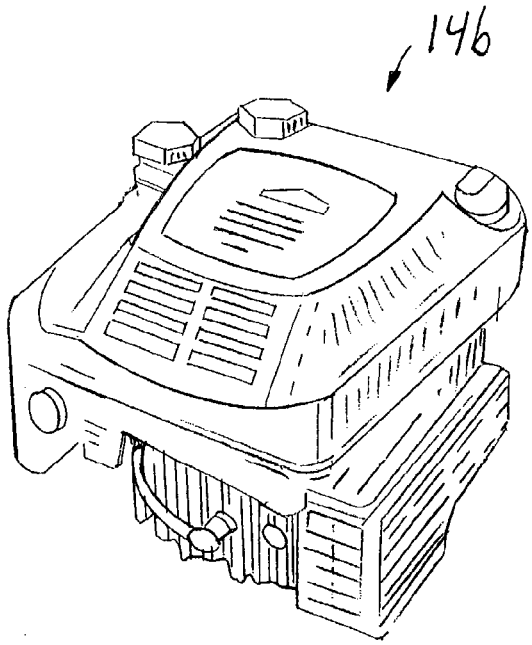
FIG. 15 is a single cylinder internal combustion engine embodying the invention.

FIG. 1 schematically illustrates a vapor control system 10 for use with a device 12 having an internal combustion engine 14. In FIG. 1, the system 10 is illustrated as configured for use in a walk-behind type lawn mower 12*a* (see FIG. 9), but could alternatively be a riding lawnmower 12*b* (See FIG. 8), a portable generator 12*c* (see FIG. 10), a pump, such as the type commonly used in a portable pressure washer 12*d* (see FIG. 11), a snowthrower 12*e* (see FIG. 12), a stand-alone generator, such as the type commonly used for an automatic backup power system 12*f* (see FIG. 13), or the like. The engine 14 can be a multi-cylinder engine, such as a V-twin or opposed-cylinder engine 14*a* (see FIG. 14), or a single-cylinder engine 14*b* (see FIG. 15).

The system 10 includes an engine intake assembly 16, a fuel tank assembly 18, an evaporative emission control device 22, and an engine control device 26. The intake assembly 16 fluidly communicates with the control device 22 through a vapor line 30, and the fuel tank assembly 18 fluidly communicates with the control device 22 through a vent line 34. All of the above components are mounted to or otherwise carried by the device 12.

The engine intake assembly 16 conveys intake air from the atmosphere toward an engine combustion chamber 38. As the air travels through the intake assembly 16, combustible fuel is mixed with the air to form an air/fuel mixture or charge. The charge is then delivered to the combustion chamber 38 where it is ignited, expands, and is subsequently discharged from the combustion chamber 38 through an engine exhaust system (not shown). The engine intake assembly 16 includes an air filter element 40, an evaporative valve 42 downstream of the filter element 40, a purge tube 46 downstream of the valve 42 and coupled to the vapor line 30, and a venturi section 50 downstream of the purge tube 46. Some embodiments of the engine intake assembly 16 may be configured for operation without the evaporative valve 42. The venturi section 50 includes an aperture 54 that communicates with a carburetor 58. The carburetor 58 receives fuel from the fuel tank assembly 18 via a fuel line 60 and regulates the delivery of the fuel to the intake assembly 16 as is well known in the art. A throttle valve 62 is located downstream of the venturi section 50 and regulates the delivery of the air/fuel mixture to the combustion chamber 38.

The fuel tank assembly 18 includes a fuel tank 66 having a filler opening 70 that is covered by a removable, sealed filler cap 74. The fuel tank 66 also includes a vent opening 78 coupled to the vent line 34 and including a rollover check valve 82 and/or a liquid vapor separator. Liquid fuel 86 such as gasoline is stored in the fuel tank 66 and flows toward the carburetor 58 along the fuel line 60. The check valve 82 substantially prevents the liquid fuel 86 from flowing through the vent line 34 should the fuel tank 66 become overturned.

The control device 22 includes a first opening 90 communicating with the vent line 34, a second opening 94 communicating with the vapor line 30, and a third opening 98 communicating with the atmosphere. The control device 22 contains a mass of activated carbon 102 or any other suitable composition that is able to store (e.g. through adsorption) fuel vapor as described further below. The engine control device 26 is operatively coupled to the valve 42 by a mechanical linkage 104 (shown only schematically in the FIGS.) such that, when the engine 14 is running, the valve 42 is in an open position (shown in phantom in FIG. 1), and when the engine 14 is not running, the valve 42 is in a closed position (shown in solid lines in FIG. 1). As illustrated in FIG. 1, the engine control device 26 takes the form of an operator bail 106 of a lawnmower 12a (see FIG. 9). In alternative embodiments, the engine control device 26 may include an air vane of a mechanical governor (not shown) of the engine 14. Various other configurations of the engine control device 26 are also possible, provided they operate substantially as described above. Preferably, the engine control device 26 is operator or mechanically actuated, thereby reducing the cost and complexity associated with the addition of electronically or microprocessor controlled components.

The vapor control system 10 is configured to reduce engine emissions that are associated with the evaporation of the liquid fuel 86 that is stored in the fuel tank 66 and that remains in the carburetor 58 when the engine 14 is not running. When the device 14 is not in use, some of the liquid fuel 86 in the fuel tank 66 may evaporate, releasing fuel vapors into the empty space of the tank 66. To control the emission of fuel vapors, the vapors are carried out of the fuel tank 66 toward the evaporative emission control device 22 along the vent line 34. Once the fuel vapors reach the control device 22, the vapor is adsorbed by the activated carbon 102 such that air emitted from the control device 22 to the atmosphere via the third opening 98 contains a reduced amount of fuel vapor.

Fuel vapors from the liquid fuel 86 remaining in the carburetor when the device 12 is not in use are also conducted to the control device 22. As described above, when the engine 14 is not running, the evaporative valve 42 is in the closed position such that fuel vapor cannot travel upstream along the engine intake assembly 16 and out the filter element 40 to the atmosphere. Fuel vapors are essentially trapped between the valve 42 and the throttle valve 62, such that they must travel along the vapor line 30 toward the control device 22 when the engine 14 is not running. These vapors are adsorbed by the activated carbon 102 in the same manner as the fuel vapors resulting from evaporation of the liquid fuel 86 in the fuel tank 66.

As the device 12 is subjected to extended periods of non-use, the carbon 102 in the control device 22 becomes saturated with fuel vapors. As a result, it is necessary to "purge" or remove the vapors from the carbon. This purging occurs while the device 12 is in use and the engine 14 is running. When the engine 14 is started, the engine control device 26 opens the valve 42 such that intake air can enter the venturi section 50. As the engine 14 runs, atmospheric air is drawn through the intake assembly toward the combustion chamber. As the air passes through the intake assembly 16 it flows over the purge tube 46, thereby creating a vacuum in the vapor line 30. In response to the formation of the vacuum in the vapor line 30, atmospheric air is drawn into the control device 22 through the third opening 98. The atmospheric air then removes fuel vapor from the activated carbon 102 and continues along the vapor line 30 toward the purge tube 46. The vapor-laden air then mixes with the intake air and is subsequently delivered to the combustion chamber 38 for ignition.

As the device 12 is subjected to extended periods of non-use, the carbon 102 in the control device 22 becomes saturated with fuel vapors. As a result, it is necessary to "purge" or remove the vapors from the carbon. This purging occurs while the device 12 is in use and the engine 14 is running. When the engine 14 is started, the engine control device 26 opens the valve 42 such that intake air can enter the venturi section 50. As the engine 14 runs, atmospheric air is drawn through the intake assembly toward the combustion chamber. As the air passes through the intake assembly 16 it flows over the purge tube 46, thereby creating a vacuum in the vapor line 30. In response to the formation of the vacuum in the vapor line 30, atmospheric air is drawn into the control device 22 through the third opening 98. The atmospheric air then absorbs the fuel vapor that is stored in the activated carbon 102 and continues along the vapor line 30 toward the purge tube 46. The vapor-laden air then mixes with the intake air and is subsequently delivered to the combustion chamber 38 for ignition.

The embodiment of the invention illustrated in FIG. 1 is configured such that as the speed of the engine 14 is increased, the rate at which the activated carbon 102 is purged also increases. Specifically, as the engine's speed is increased, the velocity of the intake air in the vicinity of the purge tube 46 also increases, which in turn increases the vacuum in the vapor line 30. The pressure drop that occurs as atmospheric air is drawn across the air filter element 40 also increases the vacuum in the vapor line 30. A greater vacuum in the vapor line 30 causes a greater amount of atmospheric air to flow through the control device 22, resulting in increased purging of the activated carbon 102. Furthermore, at higher engine speeds, a greater amount of fuel is supplied to the intake air by the carburetor 58. As such, the additional fuel introduced to the intake air in the form of fuel vapor flowing from the purge tube 46 is a relatively low percentage of the total amount of fuel in the final air/fuel mixture that is delivered to the combustion chamber 38. This configuration provides a consistent and predictable air/fuel mixture during engine 14 operation.

Figure 2:
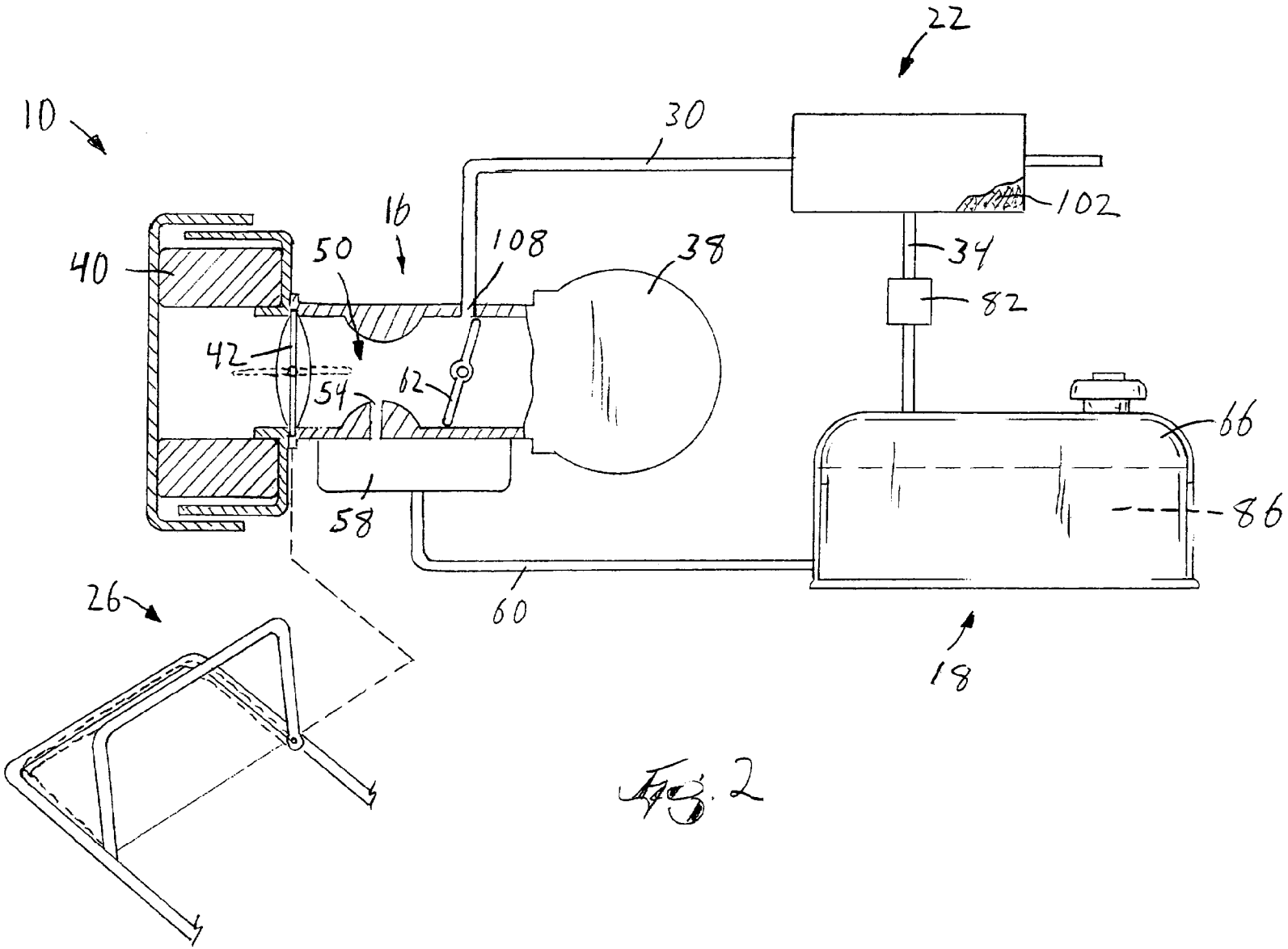
FIG. 2 is a schematic view of another internal-combustion-engine-powered device having a fuel vapor control system embodying the invention.

Referring now to FIG. 2, an alternative embodiment of the invention is illustrated wherein like parts have been given like reference numerals. The vapor control system 10 illustrated in FIG. 2 is similar to that illustrated in FIG. 1 and includes an engine intake assembly 16, a fuel tank assembly 18, an evaporative emission control device 22, and an engine control device 26. However in contrast to the system 10 of FIG. 1, the system 10 of FIG. 2 is configured such that the control device 22 is purged primarily during low speed operation of the engine 14 as described further below.

As illustrated in FIG. 2, the engine intake assembly 16 includes an aperture 108 that communicates with the vapor line 30. The aperture 108 is positioned such that it is substantially aligned with the throttle valve 62. As a result, when the throttle valve 62 is in a closed position (e.g. when engine speed is lowest), the velocity of the intake air passing over the aperture 108 is at a maximum due to the relatively small opening (e.g. cross-sectional area) through which the intake air travels. As described above with respect to the purge tube 46, high velocity intake air moving past the aperture 108 creates a vacuum in the vapor line 30 that results in the purging of the control device 22. When the throttle valve 62 is opened, the velocity of the intake passing over the aperture 108 is reduced due to the larger opening (e.g. cross-sectional area) through which the intake air travels resulting in a reduction of flow velocity near the walls of the intake assembly 16. Lower velocity air traveling over the aperture 108 results in a weaker vacuum in the vapor line 30 and less purging of the control device 22.

Figure 3:
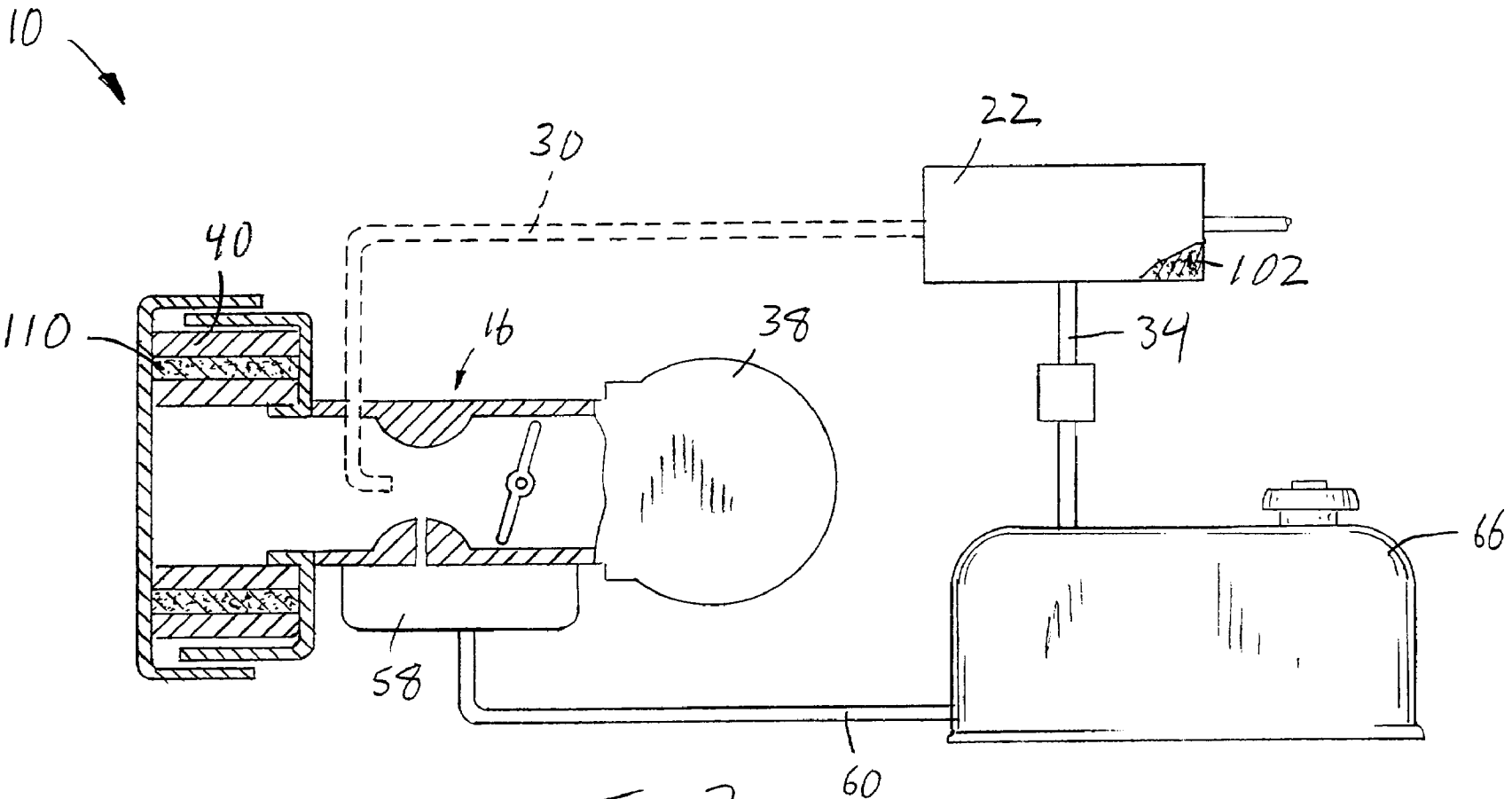
FIG. 3 is a schematic view of another internal-combustion-engine-powered device having a fuel vapor control system embodying the invention.
Figure 4:
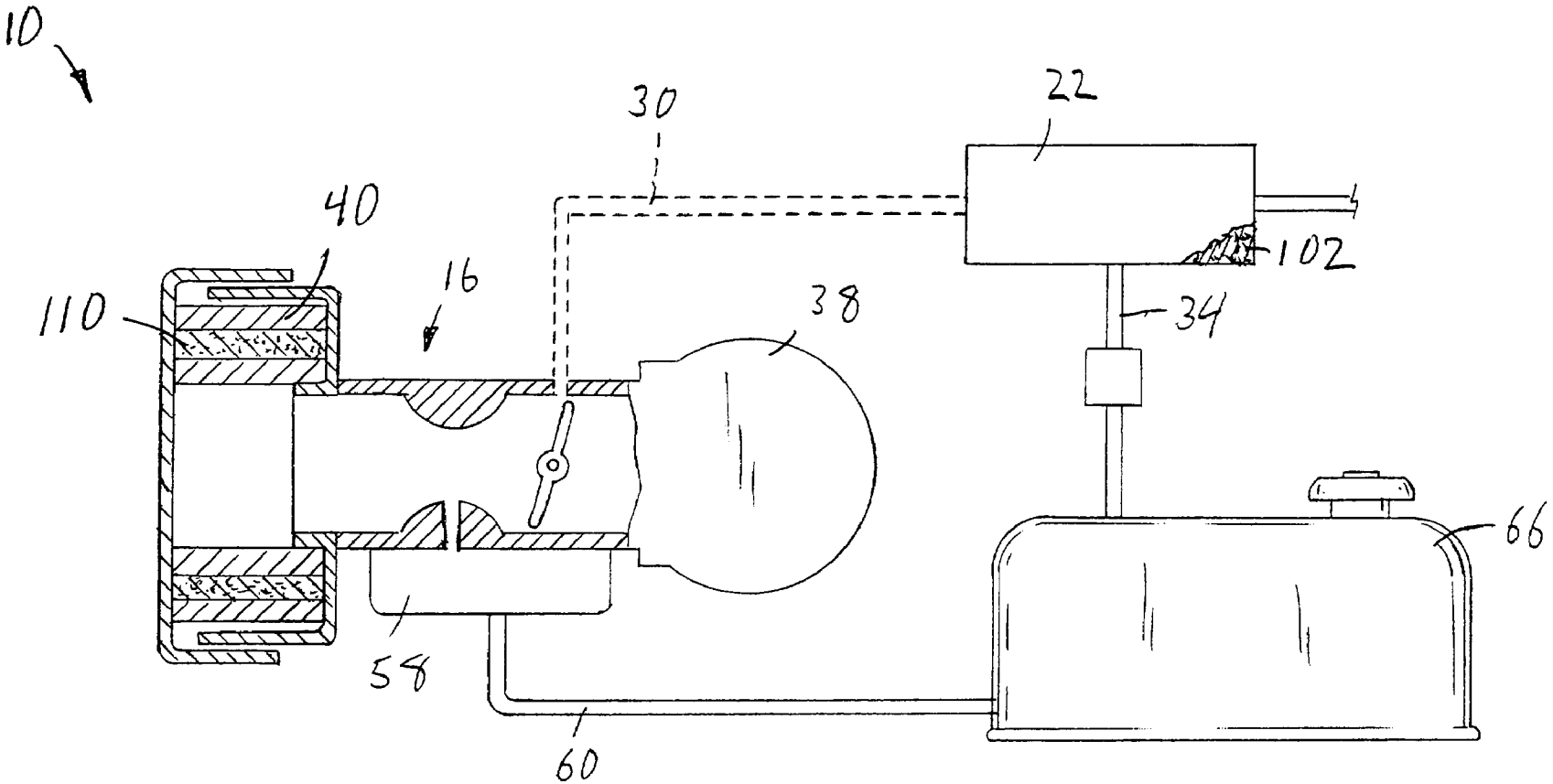
FIG. 4 is a schematic view of another internal-combustion-engine-powered device having a fuel vapor control system embodying the invention.

FIGS. 3 and 4 illustrate a further alternate vapor control system 10 including an additional mass of activated carbon 110 embedded in the filter element 40. As a result, the system 10 illustrated in FIGS. 3 and 4 does not require an evaporative valve 42 as described further below. The system 10 may be configured such that the control device 22 is primarily purged in a manner similar to the system 10 of FIG. 1, (e.g. at high engine speeds, see FIG. 3) or in a manner similar to the system 10 of FIG. 2, (e.g. at low engine speeds, see FIG. 4).

The additional mass of activated carbon 110 embedded in the filter element 40 substantially stores (e.g. through adsorption) fuel vapors that are produced by liquid fuel remaining in the carburetor 58 when the device 12 is not in use. Conversely, when the device 12 is in use, atmospheric air is drawn through the filter element 40 and the activated carbon 110. Fuel vapors stored in the carbon 110 are released to the intake air and continue through the engine intake assembly 16 toward the combustion chamber 38. Although the illustrated additional mass of activated carbon 110 is embedded within the filter element 40, the carbon 110 may also be located at other positions along the intake assembly 16 between the filter element 40 and the purge tube 46, as long as substantially all of the intake air passes through the carbon 110 before reaching the purge tube 46. Because the additional mass of activated carbon 110 embedded in the air filter 40 primarily adsorbs vapors from the relatively small quantity of liquid fuel that remains in the carburetor 58 after engine 14 shutdown, the additional mass of carbon 110 will generally be smaller than the mass of carbon 102 contained in the control device 22. However in certain devices 12 with relatively small fuel tanks 66, the additional mass of carbon 110 may be approximately equal to the mass of carbon 102 contained in the control device 22.

Figure 5:
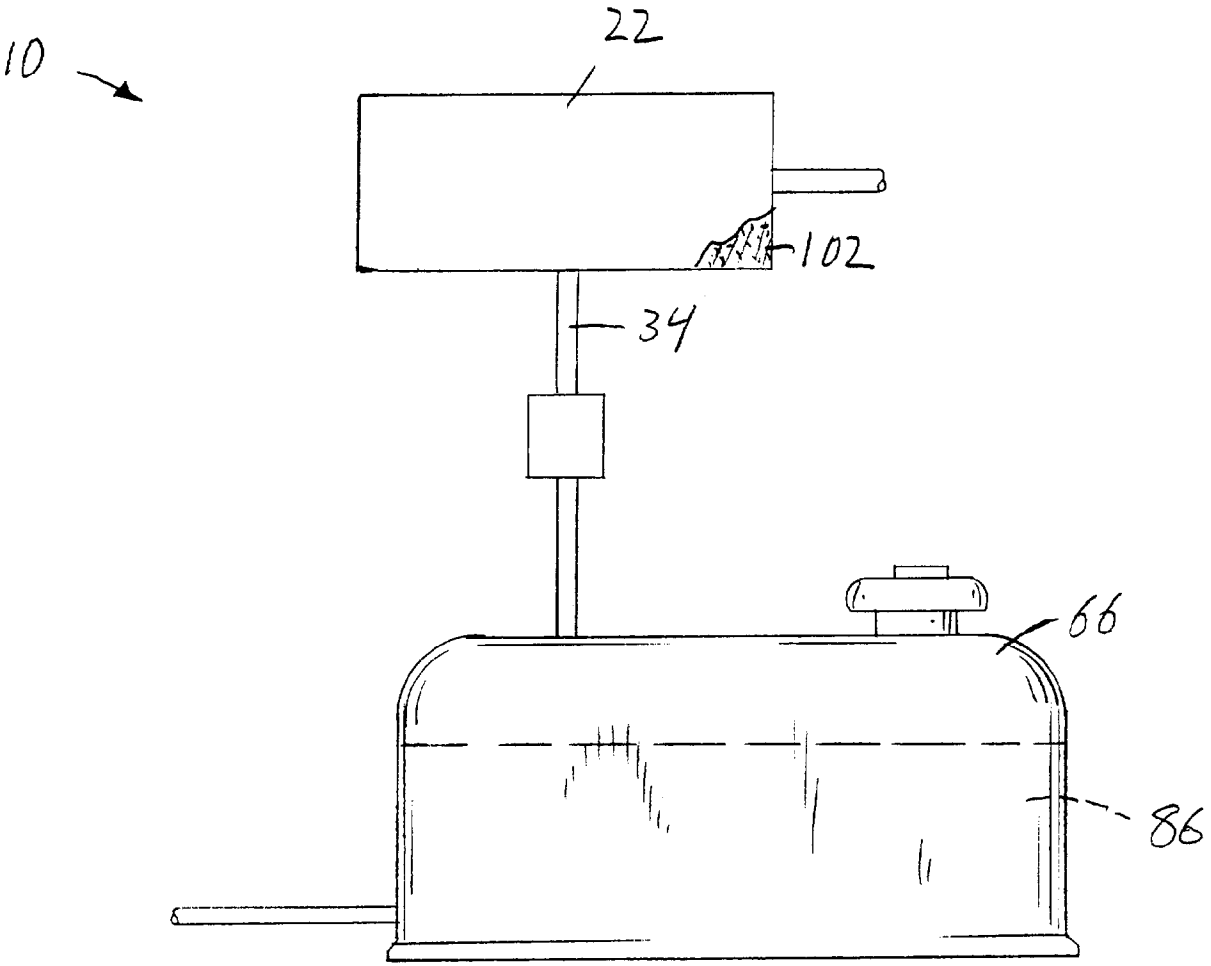
FIG. 5 is a schematic view of a fuel tank venting system embodying the invention.

A further embodiment of the invention is illustrated in FIG. 5. The system 10 of FIG. 5 is specifically sized and configured such that the vapor line 30 is unnecessary. The system of FIG. 5 is "passively purged" as described further below such that the fuel tank 66, the vent line 34 and the evaporative control device 22 cooperate to store (e.g. through adsorption) fuel vapors resulting from the evaporation of the liquid fuel in the fuel tank 66, and to purge the control device 22 by drawing atmospheric air through the control device 22. Specifically, as the various components begin to heat up, (e.g. during engine running or increased ambient temperatures) the gasses and vapors in the fuel tank 66 expand and are vented through the vent line 34 to the control device 22 where the vapors are subsequently adsorbed by the activated carbon 102. As the components cool down (e.g. when the engine is stopped or the ambient temperature decreases) or when the fuel 86 level drops, atmospheric air is drawn into the control device 22 and through the carbon 102, thereby purging the vapors from the carbon 102 and returning them to the fuel tank 66.

Figure 6:
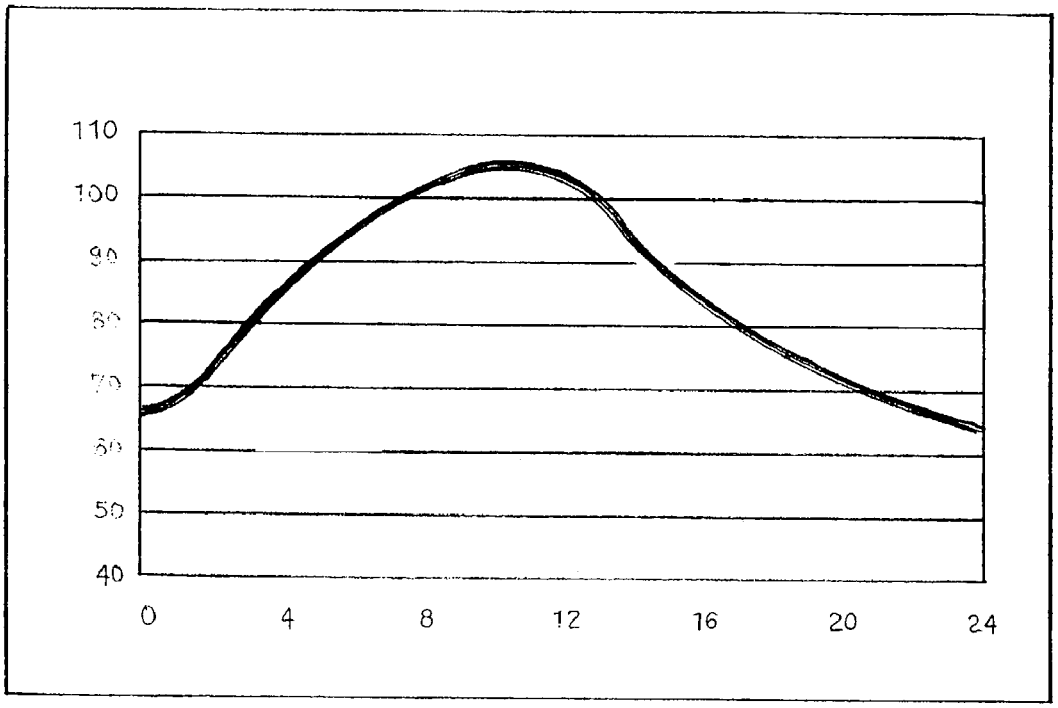
FIG. 6 is a graphical representation of a diurnal cycle for a vapor control system.

FIG. 6 illustrates a diurnal test cycle of 24 hours that is used to determine whether the present invention is capable of controlling evaporative emissions during a hypothetical summer day. FIG. 6 depicts the hypothetical ambient temperatures to which an evaporative emission control system may be subjected. The temperatures range from an overnight temperature of approximately 65° F., up to a mid-day temperature of about 105° F. followed by a return to approximately 65° F. Other test temperatures are possible depending on the specific environment and the type of use the system 10 is to be subjected to.

Figure 7:
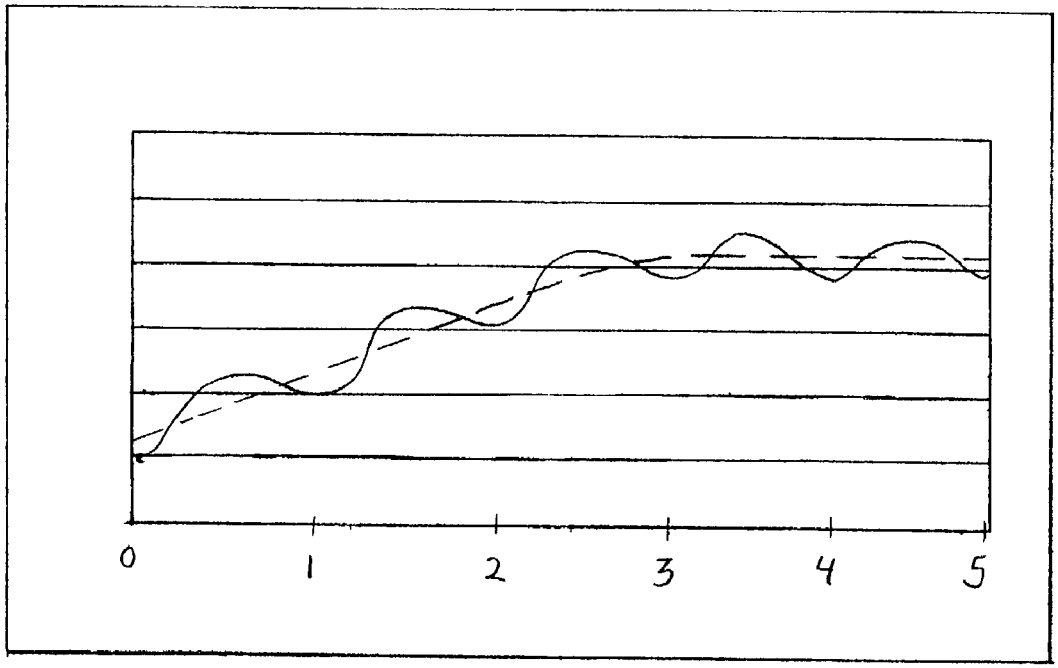
FIG. 7 is a graphical representation of the mass of a vapor control device subjected to several diurnal cycles.

FIG. 7 illustrates the performance of a hypothetical vapor control system operating over a period of several diurnals. The figure illustrates the mass of the evaporative control device 22 along the ordinate, and the number of diurnal cycles along the abscissa. As illustrated, the control device 22 is initially at a "dry mass" associated with a relatively low amount of fuel vapor stored within the carbon 102. As the diurnal cycle begins and the ambient temperature increases, some of the liquid fuel 86 stored in the fuel tank 66 begins to evaporate and the fuel vapors begin to expand. This expansion forces the vapors out of the tank 66 via the vapor line 34 and into the control device 22. As the fuel continues to evaporate and expand, the mass of the control device 22 begins to increase as the carbon 102 adsorbs fuel vapors. As the ambient temperature begins to decrease near the latter portion of an individual diurnal cycle, the liquid fuel and the fuel vapors begin to cool, such that a portion of the vapors begin to contract and/or condense into liquid fuel, thereby forming a vacuum in the fuel tank 66. Atmospheric air is drawn into the control device 22 and through the activated carbon 102 to fill the vacuum in the fuel tank 66, thus purging the fuel vapors from the carbon 102 as discussed above. As the fuel vapors are purged from the device 22, the mass of the device 22 decreases.

It is believed that over the course of several diurnal periods, the average mass of the device 22 (illustrated by the dashed line in FIG. 7) will increase until the average mass of the device 22 reaches an equilibrium value (e.g. after about 3 diurnals as illustrated in FIG. 7). Preferably the equilibrium mass value is achieved before the control device 22 reaches a completely saturated condition to control the release of fuel vapors into the atmosphere. While operating in this equilibrium regime, the device 22 captures at least a portion of the fuel vapors emitted during the first portion of the diurnal period (e.g. during ambient temperature increase), stores the vapors, and then returns the vapors to the fuel tank 66 during the latter portion of the diurnal period (e.g. during ambient temperature decrease).

A hypothetical system that is designed to operate substantially as described above will theoretically maintain the equilibrium mass value for an extended period of time (e.g. 30 days or more) without requiring any form of active purging. The specific number of diurnals required to reach equilibrium conditions, as well as the level of vapor control during the equilibrium period will vary based upon the specific system design parameters. Such a system would presumably provide effective vapor control during extended periods of non-use that are commonly associated with the devices 12 illustrated in FIGS. 8–13, as well as additional devices. Various active purge methods such as those described above may also be utilized to provide additional purging of the control device 22.

What is claimed is:

1. A self-purging evaporative emission control system for an internal combustion engine, the engine having an operating condition and a non-operating condition, the system comprising:

an engine intake assembly that provides intake air to the engine, the intake assembly including a throttle valve and a venturi portion upstream of the throttle valve;

an evaporative emission device including fuel vapor adsorbing material;

a fuel tank that provides fuel to the engine;

a vent conduit providing fluid communication between the fuel tank and the evaporative emission device and conducting fuel vapor from the fuel tank to the evaporative emission device at least when the engine is in the non-operating condition;

an atmospheric vent providing fluid communication between the evaporative emission device and the atmosphere; and a vapor conduit providing fluid communication between the evaporative emission device and the engine intake assembly and conducting fuel vapor from the evaporative emission device to the engine intake assembly in response to a decrease in pressure in the engine intake assembly when the engine is in the operating condition, the vapor conduit communicating with the engine intake assembly upstream of the venturi portion.

2. The system of claim 1, wherein the vapor conduit is in fluid communication with the engine intake assembly regardless of the condition of the engine.

3. A self-purging evaporative emission control system for an internal combustion engine, the engine having an operating condition and a non-operating condition, the system comprising:

an engine intake assembly that provides intake air to the engine, the intake assembly including a throttle valve and an evaporative valve upstream of the throttle valve;

an evaporative emission device including fuel vapor adsorbing material;

a fuel tank that provides fuel to the engine;

a vent conduit providing fluid communication between the fuel tank and the evaporative emission device and conducting fuel vapor from the fuel tank to the evaporative emission device at least when the engine is in the non-operating condition;

an atmospheric vent providing fluid communication between the evaporative emission device and the atmosphere; and a vapor conduit providing fluid communication between the evaporative emission device and the engine intake assembly and conducting fuel vapor from the evaporative emission device to the engine intake assembly in response to a decrease in pressure in the engine intake assembly when the engine is in the operating condition;

wherein the vapor conduit communicates with the engine intake assembly downstream of the evaporative valve, and wherein the evaporative valve is opened when the engine is in the operating condition and wherein the evaporative valve is closed when the engine is in the non-operating condition.

4. The system of claim 3, wherein the evaporative valve is opened and closed by a mechanical linkage responsive to an engine control device.

5. The system of claim 4, wherein the engine control device includes a lawnmower bail.

6. The system of claim 4, wherein the engine control device includes an air vane of a mechanical governor.

7. The system of claim 3, wherein the vapor conduit communicates with the engine intake assembly at a position adjacent the throttle valve.

8. The system of claim 1, wherein the engine intake assembly further comprises a filter portion upstream of the venturi portion, wherein the vapor conduit communicates with the engine intake assembly between the venturi portion and the filter portion, and wherein the system further comprises an additional mass of vapor adsorbing material upstream of the vapor conduit.

9. The system of claim 8, wherein the additional mass of vapor adsorbing material is embedded in the filter portion.

10. The system of claim 1, wherein the fuel vapor adsorbing material comprises activated carbon.

11. The system of claim 1, wherein the engine is coupled to a lawnmower.

12. The system of claim 1, wherein the engine is coupled to a generator.

13. The system of claim 1, wherein the engine is coupled to a pressure washer.

14. A self-purging evaporative emission control system for an internal combustion engine, the engine having an operating condition and a non-operating condition, the system comprising:

an engine intake assembly that provides intake air to the engine, the intake assembly including a throttle valve and a venturi portion upstream of the throttle valve;

an evaporative emission device including vapor adsorbing material that adsorbs and releases fuel vapor;

a fuel tank that provides fuel to the engine;

a vent conduit providing fluid communication between the fuel tank and the evaporative emission device and conducting fuel vapor from the fuel tank to the evaporative emission device at least when the engine is in the non-operating condition, thereby increasing an amount of fuel vapor in the vapor adsorbing material;

an atmospheric conduit providing fluid communication between the evaporative emission device and the atmosphere and conducting atmospheric air into the evaporative emission device in response to a reduction of pressure within the evaporative emission device;

a vapor conduit providing fluid communication between the evaporative emission device and the engine intake assembly and conducting fuel vapor from the evaporative emission device to the engine intake assembly in response to a decrease in pressure in the engine intake assembly when the engine is in the operating condition, thereby reducing the amount of fuel vapor in the vapor adsorbing material; and an evaporative valve upstream of the venturi portion and the vapor conduit, wherein the evaporative valve is opened when the engine is in the operating condition and closed when the engine is in the non-operating condition to reduce the emission of fuel vapor from the engine intake assembly.

15. The system of claim 14, wherein in response to an increase in ambient temperature when the engine is in the non-operating condition, fuel vapor flows from the fuel tank through the vent conduit to the evaporative emission device and at least some of the fuel vapor is adsorbed by the vapor adsorbing material, thereby reducing a concentration of fuel vapor in gases emitted from the atmospheric conduit.

16. The system of claim 14, wherein in response to a decrease in ambient temperature when the engine is in the non-operating condition, atmospheric air flows into the atmospheric conduit, through the evaporative emission device, and into the fuel tank via the vapor conduit, and wherein at least some of fuel vapor in the vapor adsorbing material is transferred to the engine intake assembly when the atmospheric air flows through the evaporative emission device, thereby reducing the amount of fuel vapor in the vapor adsorbing material.

17. The system of claim 14, wherein the vapor conduit communicates with the engine intake assembly upstream of the venturi portion.

18. The system of claim 17, wherein the throttle valve is moveable between an open position and a closed position, and wherein as the throttle valve moves from the closed position toward the open position when the engine is in the operating condition, the amount of fuel vapor in the vapor adsorbing material is reduced at an increased rate.

19. The system of claim 14, wherein the vapor conduit communicates with the engine intake assembly at a position adjacent to the throttle valve.

20. The system of claim 19, wherein the throttle valve is moveable between an open position and a closed position, and wherein as the throttle valve moves from the open position toward the closed position when the engine is in the operating condition, the amount of fuel vapor in the vapor adsorbing material is reduced at an increased rate.

21. The system of claim 14, wherein the engine is coupled to a lawnmower.

22. The system of claim 14, wherein the engine is coupled to a generator.

23. The system of claim 14, wherein the engine is coupled to a pressure washer.

24. An evaporative emission control system for an internal combustion engine, the engine having an operating condition and a non-operating condition, the system comprising:

an evaporative emission device including a first mass of fuel vapor adsorbing material;

a fuel tank that provides fuel to the engine;

a vent conduit providing fluid communication between the fuel tank and the evaporative emission device and conducting fuel vapor from the fuel tank to the evaporative emission device at least when the engine is in the non-operating condition; and an engine intake assembly that provides intake air to the engine, the intake assembly including a throttle valve and a second mass of fuel vapor adsorbing material upstream of the throttle valve; and a vapor conduit providing fluid communication between the evaporative emission device and the engine intake assembly and conducting fuel vapor from the evaporative emission device to the engine intake assembly in response to a decrease in pressure in the engine intake assembly when the engine is in the operating condition, wherein the engine intake assembly includes a venturi portion upstream of the throttle valve, and wherein the vapor conduit communicates with the engine intake assembly upstream of the venturi portion and downstream of the second mass of fuel vapor adsorbing material.

25. The system of claim 24, wherein the first and second masses of fuel vapor adsorbing material comprise activated charcoal.

26. The system of claim 24, wherein the vapor conduit is in fluid communication with the engine intake assembly regardless of whether the engine is operating.

27. The system of claim 24, wherein the vapor conduit communicates with the engine intake assembly at a position adjacent the throttle valve.

28. The system of claim 24, wherein the intake assembly includes an air filter element upstream of the throttle valve, and wherein the second mass of fuel vapor adsorbing material is embedded within the air filter element.

29. An evaporative emission control system for an internal combustion engine, the engine having an operating condition and a non-operating condition, the system comprising:

an evaporative emission device including a mass of fuel vapor adsorbing material;

a fuel tank that provides fuel to the engine;

a vent conduit providing fluid communication between the fuel tank and the evaporative emission device;

an engine intake assembly that provides intake air to the engine, the intake assembly including a throttle valve; and an evaporative valve upstream of the throttle valve, the evaporative valve opened when the engine is in the operating condition and closed when the engine is in the non-operating condition to reduce the emission of fuel vapor from the engine intake assembly, wherein the evaporative valve is opened and closed by a mechanical linkage responsive to an engine control device, and wherein the engine control device includes at least one of a lawnmower bail and a governor.

30. The system of claim 29, wherein the evaporative valve substantially seals the engine intake assembly when closed.

31. The system of claim 29, further comprising a vapor conduit providing fluid communication between the evaporative emission device and the engine intake assembly, the vapor conduit communicating with the engine intake assembly downstream of the evaporative valve.

32. The system of claim 31, wherein the vapor conduit communicates with the engine intake assembly at a position adjacent to the throttle valve.

33. An evaporative emission control system comprising:

an evaporative emission device including a mass of fuel vapor adsorbing material;

a fuel tank having a tank volume;

an atmospheric vent providing fluid communication between the evaporative emission device and the atmosphere;

a vent conduit providing fluid communication between the fuel tank and the evaporative emission device, the vent conduit enabling flow from the fuel tank to the evaporative emission device in response to an increase in pressure within the fuel tank, and enabling flow from the evaporative emission device to the fuel tank in response to a decrease in pressure within the fuel tank;

wherein the device volume and the tank volume are sized relative to one another such that substantially no fuel vapor passes from the evaporative emission device to the atmosphere, and such that a vapor conduit providing fluid communication between the evaporative emission device and an engine intake assembly is eliminated.

34. The system of claim 33, wherein the fuel tank includes a filler cap, and wherein the atmospheric vent is disposed in the filler cap.

35. The system of claim 3, wherein the engine intake assembly further includes a venturi portion between the evaporative valve and the throttle valve, and wherein the vapor conduit communicates with the engine intake assembly between the evaporative valve and the venturi portion.

36. The system of claim 14, wherein the evaporative valve is opened and closed by a mechanical linkage responsive to an engine control device.

37. The system of claim 36, wherein the engine control device includes a lawnmower bail.

38. The system of claim 36, wherein the engine control device includes an air vane of a mechanical governor.

* * * * *